US009352356B2

(12) United States Patent
Drouin et al.

(10) Patent No.: US 9,352,356 B2
(45) Date of Patent: May 31, 2016

(54) PROCESSES FOR PREPARING TRIM BOARDS

(71) Applicant: Produits Matra Inc., Saint-Martin (CA)

(72) Inventors: Nicholas Drouin, St-Georges-de-Beauce (CA); Patrick Beaulieu, St-Georges-de-Beauce (CA); Jean-François Drouin, St-Georges-de-Beauce (CA)

(73) Assignee: PRODUITS MATRA INC., Saint-Martin (CA)

( * ) Notice: Subject to any disclaimer, the term of this patent is extended or adjusted under 35 U.S.C. 154(b) by 0 days.

(21) Appl. No.: 13/796,802

(22) Filed: Mar. 12, 2013

(65) Prior Publication Data

US 2013/0280428 A1 Oct. 24, 2013

Related U.S. Application Data

(60) Provisional application No. 61/636,811, filed on Apr. 23, 2012.

(51) Int. Cl.

| | |
|---|---|
| ***B05D 7/06*** | (2006.01) |
| ***B05D 7/08*** | (2006.01) |
| ***B05D 7/00*** | (2006.01) |

(52) U.S. Cl.

CPC .. *B05D 7/06* (2013.01); *B05D 7/08* (2013.01); *B05D 7/546* (2013.01)

(58) Field of Classification Search

USPC ..... 427/408

See application file for complete search history.

(56) References Cited

U.S. PATENT DOCUMENTS

| | | | | |
|---|---|---|---|---|
| 6,001,207 | A | 12/1999 | Enlow et al. | |
| 6,245,141 | B1 | 6/2001 | Walker, Jr. et al. | |
| 6,383,652 | B1 | 5/2002 | Templeton et al. | |
| 6,531,223 | B1 * | 3/2003 | Rota et al. | 428/402 |
| 6,660,086 | B1 * | 12/2003 | Prince | B05C 3/005 118/125 |
| 7,553,549 | B2 | 6/2009 | Liles et al. | |
| 7,838,446 | B2 | 11/2010 | Jarck | |
| 7,867,622 | B2 | 1/2011 | Endo et al. | |
| 2005/0069698 | A1 | 3/2005 | Eubanks et al. | |
| 2006/0024480 | A1 | 2/2006 | Lyons et al. | |
| 2006/0177649 | A1 | 8/2006 | Clark et al. | |
| 2006/0222829 | A1 | 10/2006 | Dean et al. | |
| 2007/0087213 | A1 | 4/2007 | Robinson et al. | |
| 2007/0116732 | A1 | 5/2007 | Goebel et al. | |
| 2008/0152829 | A1 | 6/2008 | Dean et al. | |
| 2012/0136105 | A1 * | 5/2012 | Gebhard | C08L 67/08 524/439 |
| 2012/0244288 | A1 * | 9/2012 | Young | C08J 3/03 427/385.5 |

FOREIGN PATENT DOCUMENTS

| | | |
|---|---|---|
| WO | 0166266 | 9/2001 |

OTHER PUBLICATIONS

Atlanta Painting GreenWave Solutions' Atlanta Painting Division, Atlanta, "Tannin Bleed", 2009.

Walter Christiansen, "Extractive Bleeding: Not a Stain or Paint Failure", 2008.

Benjamin Moore, "Super Spec HP—D.T.M. Alkyd Low Lustre P23", Nov. 9, 2011.

Sherwin Williams, "Exterior Oil-Based, Wood Primer Y24W8020", Mar. 2013.

Paint Quality Institute, "Understanding Paint—Water Based vs Solvent Based", [Retrieved on Feb. 19, 2016].

* cited by examiner

*Primary Examiner* — William Phillip Fletcher, III

(74) *Attorney, Agent, or Firm* — Bereskin & Parr LLP/S.E.N.C.R.L., s.r.l.

(57) ABSTRACT

There are provided processes for manufacturing trim boards. The processes can comprise applying a thin layer comprising a solvent based alkyd based primer sealer on at least one surface of the trim board; heat drying the thin layer so as to at least partially cure the thin layer comprising the solvent based alkyd based primer sealer; cooling the at least one surface; and applying a thin layer comprising a sealer on the thin layer comprising the solvent based alkyd based primer sealer. There are also provided methods for reducing and/or preventing migration of tannins in pine wood.

29 Claims, 2 Drawing Sheets

PROCESSES FOR PREPARING TRIM BOARDS

CROSS-REFERENCE TO RELATED APPLICATIONS

The present application claims priority on U.S. 61/636,811 filed on Apr. 23, 2012. This document is hereby incorporated by reference in its entirety.

TECHNICAL FIELD

The present disclosure relates to improvements in the field of the production of trim boards. For example, it relates to processes that can be used for preparing trim boards such as those used as a finishing material for the outermost layer of a building.

BACKGROUND OF THE DISCLOSURE

In the production of trim boards several factors have to be considered in order to manufacture a good quality product at reasonable costs. For example, migration of wood tannins has to be avoided or reduced in order to avoid generating yellowish and/or brownish spots on the manufactured wood products. Moreover, the trim boards should have a surface as smooth as possible so as to hide jointing lines.

So far, several solutions have been proposed but there is still a need for providing a product and a manufacturing process that would provide an efficient and/or low cost solutions so as to overcome such drawbacks.

SUMMARY OF THE DISCLOSURE

According to one aspect, there is provided a process for manufacturing a trim board, the process comprising:

- applying a thin layer comprising an alkyd based primer sealer on at least one surface of the trim board;
- heat drying the thin layer so as to at least partially cure the thin layer comprising the alkyd based primer sealer;
- cooling the at least one surface; and
- applying a thin layer comprising a sealer on the thin layer comprising the alkyd based primer sealer.

According to another aspect, there is provided a method for reducing and/or preventing migration of tannins in pine wood, the method comprising:

- applying a thin layer comprising an alkyd based primer sealer on at least one surface of the pine wood;
- heat drying the thin layer so as to at least partially cure the thin layer comprising the alkyd based primer sealer;
- cooling the at least one surface; and
- applying a thin layer comprising a sealer on the thin layer comprising the alkyd based primer sealer.

BRIEF DESCRIPTION OF DRAWINGS

In the following drawings, which represent by way of example only, various embodiments of the disclosure.

DETAILED DESCRIPTION OF VARIOUS EMBODIMENTS

Figure 1:
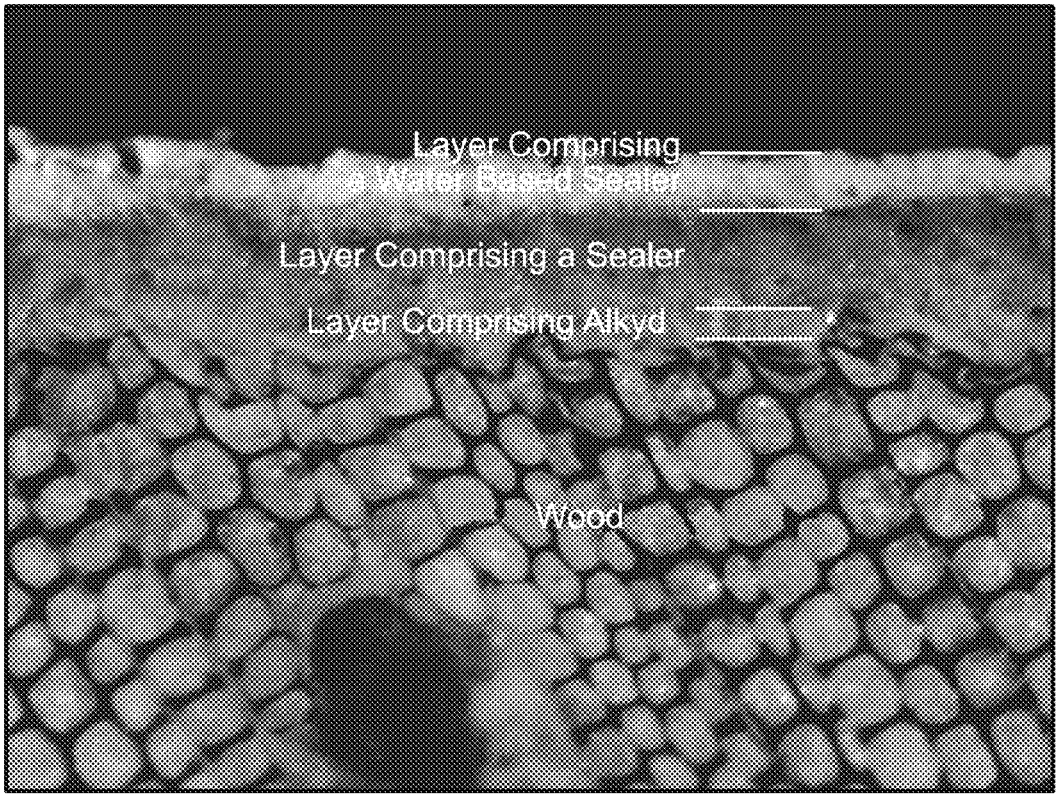
FIG. 1 is a microscopic picture of a cross-section of a trim board product obtained by an example of a process of the present disclosure.

The following non-limiting examples further illustrate the technology described in the present disclosure.

In the processes and methods of the present disclosure, the at least one surface can be at least one surface comprising or made of a pine wood. For example, the pine wood can be white pine wood. White pine wood is also know as *Pinus strobus*, eastern white pine, northern white pine, soft pine, or Weymouth pine.

For example, the thin layer comprising the alkyd based primer sealer can have a thickness that is less than about 0.25 mm, less than about 0.2 mm, less than about 0.12 mm, less than about 0.1 mm, less than about 0.05 mm, less than about 0.025 mm or less than about 0.015 mm. Alternatively, the thin layer comprising the alkyd based primer sealer can have a thickness that is about 0.01 mm to about 0.25 mm, about 0.01 mm to about 0.15 mm, about 0.015 mm to about 0.15 mm, about 0.02 mm to about 0.15 mm or about 0.025 mm to about 0.1 mm.

For example, the heat drying can be carried out by means of a forced air dryer.

For example, the heating can be carried out during a period of time of about 1 to about 6 hours, about 2 to about 4 hours.

For example, the applying of the thin layer, the heat drying and the cooling can be carried out in a period of time of less than about 8 hours or less than about 6 hours.

For example, the alkyd based primer sealer can have a VOCs content of less than 400 g/L.

For example, the thin layer comprising the alkyd based primer sealer can represent less than 20%, less than 15%, or less than 10% of the total thickness of products added on the at least one surface.

For example, the thin layer comprising the sealer can have a thickness that is less than about 0.25 mm, less than about 0.2 mm, less than about 0.15 mm, less than about 0.12 mm or less than about 0.1 mm. Alternatively, the thin layer comprising the sealer can have a thickness that is about 0.02 mm to about 0.25 mm, about 0.05 mm to about 0.2 mm, about 0.07 mm to about 0.15 mm, about 0.01 mm to about 0.15 mm, about 0.015 mm to about 0.15 mm, about 0.02 mm to about 0.15 mm or about 0.025 mm to about 0.1 mm.

For example, at least one surface of the trim board can be a top surface of the trim board.

For example, the processes and methods can further comprise applying, on a back surface of the trim board, a layer comprising a water based primer sealer.

For example, the processes and methods can further comprise at least partially drying the layer of the water based primer sealer.

For example, the layer of the water based primer sealer can be dried by means of an infrared oven.

For example, the water based primer sealer can be applied on the back surface after the cooling.

For example, the water based primer sealer can be applied on the back surface before applying the thin layer of sealer on the thin layer comprising the alkyd based primer sealer.

For example, the layer comprising the water based primer sealer has a thickness that is less than about 0.25 mm, less than about 0.2 mm, less than about 0.15 mm, less than about 0.12 mm or less than about 0.1 mm. Alternatively, the layer comprising the water based primer sealer can have a thickness that is about 0.02 mm to about 0.25 mm, about 0.05 mm to about 0.2 mm, about 0.07 mm to about 0.15 mm, about 0.01 mm to about 0.15 mm, about 0.015 mm to about 0.15 mm, about 0.02 mm to about 0.15 mm or about 0.025 mm to about 0.1 mm.

For example, the thin layer comprising the alkyd based primer sealer can further comprise a drying agent.

For example, the processes and methods can further comprises, before applying a thin layer comprising a sealer on the thin layer comprising the alkyd based primer sealer, applying a layer comprising a drying agent on the thin layer comprising the alkyd based primer sealer.

For example, the processes and methods can further comprise applying, on the layer comprising the sealer, a layer comprising a water based primer sealer.

For example, the layer comprising the water based primer sealer can have a thickness that is less than about 0.25 mm, that is less than about 0.2 mm, less than about 0.15 mm, less than about 0.12 mm, less than about 0.1 mm. Alternatively, the water based primer sealer can have a thickness that is about 0.02 mm to about 0.25 mm, about 0.05 mm to about 0.2 mm, about 0.07 mm to about 0.15 mm, about 0.01 mm to about 0.15 mm, about 0.015 mm to about 0.15 mm, about 0.02 mm to about 0.15 mm or about 025 mm to about 0.1 mm.

For example, the processes and methods can further comprise, before applying the thin layer comprising the sealer on the thin layer comprising the alkyd based primer sealer, sanding the thin layer comprising the alkyd based primer sealer.

For example, the processes and methods can further comprise, before applying the layer comprising the water based primer sealer on the thin layer comprising the sealer, sanding the thin layer comprising the sealer.

The following examples relate to examples of processes of the present disclosure.

A very thin layer (for example less than about 0.25 mm (values such as about 0.01 mm to about 0.25 mm) of an alkyd primer can be applied on one surface of the trim board (for example the top surface i.e. the surface to be viewed when the trim board is installed (not the one facing a wall of a building for example). The trim board was made of pine wood (white pine wood). The wood can be lathed with Breeze strips which allow drying to occur between the strips. The application is so thin that nothing sticks to the strip and no visible marks remain on the surface of the wood. The bundles of wood are then moved into a forced hot air dryer so the solvents (mineral spirits) may evaporate. This step can last about 3 hours, each bundle of product enters into the front of the dryer at the same time as a bundle exits at the other end. Afterwards, the wood cools while waiting for the next application. Cooling involves hardening of the alkyd resin. This method allows the drying period to be shortened from 24 hours to 6 hours.

The alkyd based primer sealer can be, for example, SHERWIN WILLIAMS EXTERIOR OIL BASED WOOD primer (solvent: aliphatic hydrocarbons), SHERWIN WILLIAMS SEA SHORE OIL STAIN BLOCKING primer or BENJAMIN MOORE SUPER SPEC ALKYD (solvent: petroleum distillates).

It was observed that the alkyd based primer sealer is effective to close the pores of the soft wood so that it limits or eliminates swelling of the fibers during the application of future water based products. Without wishing to be bound to such a theory, applicants believe that by applying a thin layer of the primer sealer, water may then still pass between the fibers, but it cannot penetrate into the fibers and thus cause it to swell. The thickness applied is as thin as possible while still attaining this result in order to reduce the environmental impact to a minimum. An alkyd layer that is too thick would, in effect, take too long to dry, and it would prevent the flow of water between the fibers of the wood and thus decrease the mechanical adhesion of the following layers which are water based. The alkyd used has a low VOCs level (lower than 380 g/L) and this layer has a thickness that is about less than 20% of the total thickness applied on the substrate once the entire method is finished.

The optional addition of a drying agent to the alkyd can be effective to allow a portion of the tannins to be converted to salts and this prevents them from migrating afterwards, since it is no longer in liquid form. The drying agent can be in admixture with the alkyd based primer sealer or it can be applied before it, in a separate layer.

Then, the application of a layer comprising a water based primer sealer on another surface of the trim board (for example a back surface of the trim board i.e. the surface adapted to contact the surface on which the trim board is installed) can be carried out. The thickness applied can be about less than 0.25 mm (for example about 0.05 mm to about 0.2 mm or about 0.07 mm to about 0.15 mm). This layer can be infrared dried during a few minutes in an oven. The board is returned afterwards for the rest of the process.

It was found that apart from the aesthetic function, this layer of water based primer on the back can serve to slow down the passage of the moisture while accepting it at the same time, since the application of the sealer on the front, can substantially totally block the passage of the humidity. The moisture is advantageously able to move somewhere to avoid possible flaws in the product such as separation of the paint into small bubbles or degradation of wood which has remained wet too long (rot). Later in the process, but on the back of the board, an indication to the user of which side is the back side can be printed at high speed in black ink. The printing can be repeated every 60 centimeters in such a way that even the short ends (cut) are identified.

Then, a layer comprising a sealer can be applied on the layer comprising the alkyd based primer sealer so as to block the tannins that have not been converted into salts by the optional drying agent present in the alkyd based primer sealer (or added afterward) and the brown or yellow stains that could otherwise migrate to the surface and discolor the layer of the finish. The sealer thus allows the creation of a watertight barrier to block moisture and any other factor that could deteriorate the wood over the years. Sanding the wood before the painting steps, the thinness of the alkyd layer as well as brushing through the wood fibers allow a very strong mechanical seal on the wood. The layer of sealer can be about less than 0.25 mm (for example about 0.05 mm to about 0.2 mm or about 0.07 mm to about 0.15 mm). Such a layer can cling to the irregularities in the wood still present and between the fibers following the application of the alkyd based primer sealer.

The sealer can be, for example, SHERWIN WILLIAMS PROSHIELD WATERBORNE primer/sealer, SHERWIN WILLIAMS TERMINATOR primer/sealer, SHERWIN WILLIAMS LOK TITE primer and stain sealer, SHERWIN WILLIAMS MAXWOOD exterior primer/sealer, SHERWIN WILLIAMS SEA SHORE EXTERIOR primer/sealer, or BENJAMIN MOORE SUPER SPEC BUSAN latex primer/sealer.

A layer comprising a water based primer sealer can then be added over the layer comprising the sealer (the layer comprising the sealer that was added on the layer comprising the alkyd based primer sealer). It can be the last layer that completes the smooth finish by filling in the last bit of roughness that may remain after application of the sealer, and this is possible due to the application of the alkyd. In addition to the aesthetic functions, this last application can help, together with the other applications, to prevent the trim boards from sticking together. Finally, the water based primer sealer is not designed to be permanently exposed to the weather. A light sanding between each step ensures the smoothest finish possible.

The water based primer sealer can be, for example, SHERWIN WILLIAMS FAST-DRYING primer, SHERWIN WILLIAMS MULTI-PURPOSE LATEX primer, BENJAMIN MOORE FRESH START primer or BENJAMIN MOORE AURA WATERBORNE EXTERIOR paint.

As it can be seen on FIG. 1, the white pine trim board product obtained from the previous example comprises the following layers, added in the following order, on the top surface of the wood core portion: the layer comprising the alkyd based primer sealer; the layer comprising the sealer; and the layer comprising the water based primer sealer. The layer (comprising the water based primer sealer) applied on the bottom surface of the trim board is not shown on FIG. 1.

Figure 2:
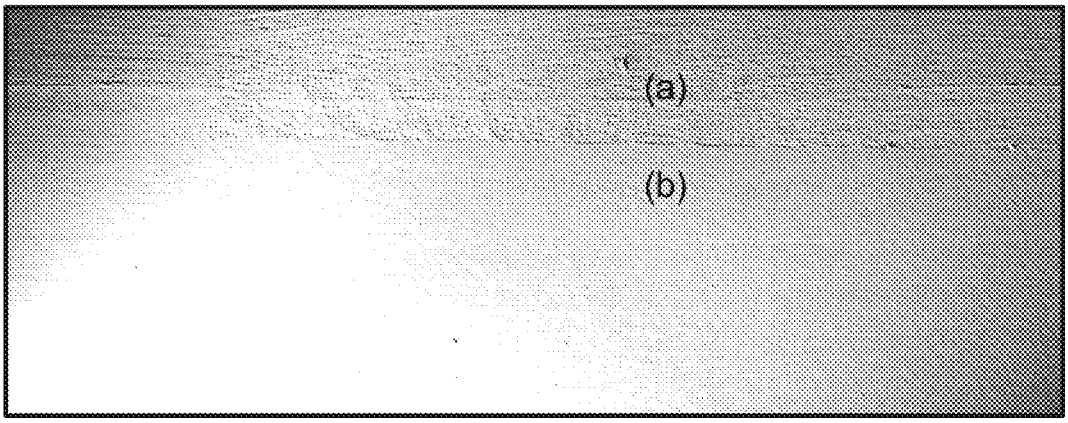
FIG. 2 is a picture showing the difference of smoothness of different sections of the top surface on a trim board: section (a) on which a layer of an alkyd based primer sealer has been applied; and section (b) on which no such layer has been applied.

As it can be seen from FIG. 2, there is a significant difference between a section (a) of the white pine trim board on which the layer comprising the alkyd based primer sealer was applied and a section (b) on which no such layer comprising the alkyd based primer sealer. In fact, as it can be seen from these Figures, the section (b) for which the alkyd based primer sealer is absent have an important swelling of the wood grain. In other words, the surface of the trim boards is a lot more smoother when the layer comprising the alkyd based primer sealer is applied thereto (see section (a)). In order to obtain such differences, a masking tape was applied on the section (b) of each trim board and such a tape has been removed after the application of the alkyd based primer sealer.

It was found that when using the processes and methods of the present disclosure, the following considerable advantages were encountered:

the processes and methods of the present disclosure allow for blocking and/or preventing migration of wood tannins. In fact, one of the drawbacks of using white pine trim boards is the wood tannins migration that will eventually occur thereby generating yellowish and/or brownish spots on wood.

Without wishing to be bound to such a theory, it is believed that the processes and methods of the present disclosure are effective to block and/or prevent migration of organic salts and/or extractable compounds found in wood such as pine wood (e.g. white pine wood)

The person skilled in the art will understand that the processes of the present disclosure can be carried out in various orders. The example presented above is disclosed with a certain order in which certain products are applied but the technology disclosed in the present disclosure encompasses carrying out such processes in a different order. For example, the back surface can be treated before the top surface. Moreover, the sealer (added on the alkyd based primer sealer layer) can be applied before or after the application of the water based primer sealer on the back surface of the trim board.

While a description was made with particular reference to the specific embodiments, it will be understood that numerous modifications thereto will appear to those skilled in the art. Accordingly, the above description and accompanying drawings should be taken as specific examples and not in a limiting sense.

What is claimed is:

1. A process for manufacturing a trim board, said process comprising:

applying a layer comprising a solvent based alkyd based primer sealer on at least one surface of said trim board, wherein said layer comprising said solvent based alkyd based primer sealer has a thickness that is less than about 0.25 mm, and wherein said solvent based alkyd based primer sealer has a VOCs content of less than 400 q/L;

heat drying said layer so as to at least partially cure said layer comprising said solvent based alkyd based primer sealer, wherein said heating is carried out during a period of time of about 1 to about 6 hours;

cooling said at least one surface; and applying a layer comprising a sealer on said layer comprising said solvent based alkyd based primer sealer.

2. The process of claim 1, wherein said layer comprising said solvent based alkyd based primer sealer has a thickness that is less than about 0.1 mm.

3. The process of claim 1, wherein said layer comprising said solvent based alkyd based primer sealer has a thickness that is about 0.015 mm to about 0.15 mm.

4. The process of claim 1, wherein said layer comprising said solvent based alkyd based primer sealer has a thickness that is about 0.025 mm to about 0.1 mm.

5. The process of claim 4, wherein said layer comprising said sealer has a thickness that is less than about 0.15 mm.

6. The process of claim 4, wherein said layer comprising said sealer has a thickness that is about 0.05 mm to about 0.2 mm.

7. The process of claim 6, wherein said process further comprises applying, on said layer comprising said sealer, a layer comprising a water based primer sealer.

8. The process of claim 7, wherein said layer comprising said water based primer sealer has a thickness that is about 0.05 mm to about 0.2 mm.

9. The process of claim 1, wherein said solvent based alkyd based primer sealer has a VOCs content of less than 380 g/L.

10. The process of claim 1, wherein said layer comprising said solvent based alkyd based primer sealer represents less than 20% of the total thickness of products added on said at least one surface.

11. The process of claim 1, wherein said process further comprises applying, on a back surface of said trim board, a layer comprising a water based primer sealer.

12. The process of claim 11, further comprising at least partially drying said layer of said water based primer sealer.

13. The process of claim 1, wherein said process further comprises, before applying a layer comprising a sealer on said layer comprising said solvent based alkyd based primer sealer, applying a layer comprising a drying agent on said layer comprising said solvent based alkyd based primer sealer.

14. The process of claim 1, wherein said trim board is made of white pine wood.

15. The process of claim 1, wherein the solvent of said solvent based alkyd based primer sealer is chosen from mineral spirits, petroleum distillates and aliphatic hydrocarbons.

16. The process of claim 1, wherein the solvent of said solvent based alkyd based primer sealer is mineral spirits.

17. A method for reducing and/or preventing migration of tannins in pine wood, said method comprising:

applying a layer comprising a solvent based alkyd based primer sealer on at least one surface of said pine wood, wherein said layer comprising said solvent based alkyd based primer sealer has a thickness that is less than about 0.25 mm, and wherein the solvent of said solvent based alkyd based primer sealer is chosen from mineral spirits, petroleum distillates and aliphatic hydrocarbons;

heat drying said layer so as to at least partially cure said layer comprising said solvent based alkyd based primer sealer, wherein said heating is carried out during a period of time of about 1 to about 6 hours;

cooling said at least one surface; and applying a layer comprising a sealer on said layer comprising said solvent based alkyd based primer sealer.

18. The method of claim 17, wherein said pine wood is wood of white pine.

19. The method of claim 18, wherein said layer comprising said solvent based alkyd based primer sealer has a thickness that is about 0.015 mm to about 0.15 mm.

20. The method of claim 19, wherein said layer comprising said sealer has a thickness that is about 0.05 mm to about 0.2 mm.

21. The method of claim 19, wherein said method further comprises applying, on said layer comprising said sealer, a layer comprising a water based primer sealer, and wherein said layer comprising said water based primer sealer has a thickness that is about 0.05 mm to about 0.2 mm.

22. The method of claim 17, wherein said heating is carried out during a period of time of about 2 to about 4 hours.

23. The process of claim 17, wherein the solvent of said solvent based alkyd based primer sealer is chosen from mineral spirits and petroleum distillates.

24. The process of claim 17, wherein the solvent of said solvent based alkyd based primer sealer is mineral spirits.

25. A process for manufacturing a trim board, said process comprising:

applying a layer comprising a solvent based alkyd based primer sealer on at least one surface of said trim board, wherein said layer comprising said solvent based alkyd based primer sealer has a thickness that is less than about 0.25 mm, and wherein said solvent based alkyd based primer sealer has a VOCs content of less than 400 q/L;

heat drying said layer so as to at least partially cure said layer comprising said solvent based alkyd based primer sealer, wherein said heating is carried out during a period of time of about 1 to about 6 hours;

cooling said at least one surface;

applying a layer comprising a sealer on said layer comprising said solvent based alkyd based primer sealer; and applying, on said layer comprising said sealer, a layer comprising a water based primer sealer.

26. The process of claim 1, wherein said heating is carried out during a period of time of about 2 to about 4 hours.

27. The process of claim 25, wherein said heating is carried out during a period of time of about 2 to about 4 hours.

28. The process of claim 25, wherein the solvent of said solvent based alkyd based primer sealer is chosen from mineral spirits, petroleum distillates and aliphatic hydrocarbons.

29. The process of claim 25, wherein the solvent of said solvent based alkyd based primer sealer is mineral spirits.

* * * * *